United States Patent [19]

Proudfit

[11] Patent Number: 5,000,458

[45] Date of Patent: Mar. 19, 1991

[54] GOLF BALL WITH OPTICAL BRIGHTENER IN THE PRIMER COAT

[75] Inventor: James R. Proudfit, Humboldt, Tenn.

[73] Assignee: Wilson Sporting Goods Co., River Grove, Ill.

[21] Appl. No.: 511,462

[22] Filed: Apr. 20, 1990

[51] Int. Cl.[5] ..... A63B 37/12

[52] U.S. Cl. ..... 273/235 A; 273/213

[58] Field of Search ..... 273/235 R, 235 A, 235 B, 273/213, 218, 233, 234, 22, 24

[56] References Cited

U.S. PATENT DOCUMENTS

| | | | |
|---|---|---|---|
| 4,679,794 | 7/1987 | Yamada et al. | 273/235 R |
| 4,679,795 | 7/1987 | Melvin et al. | 273/235 R |
| 4,798,386 | 1/1989 | Berard | 273/235 R |
| 4,802,674 | 2/1989 | Kitaoh | 273/235 A |
| 4,865,326 | 9/1989 | Isaac et al. | 273/235 A |

*Primary Examiner*—George J. Marlo

[57] ABSTRACT

A golf ball consists of a core and a cover. A transparent primer coat is applied over the cover, and a transparent outermost clear coat is applied over the primer coat. The primer coat contains an optical brightener in the amount of about 0.45 to 2.7% by weight of the solids content of the primer coat.

8 Claims, 1 Drawing Sheet

GOLF BALL WITH OPTICAL BRIGHTENER IN THE PRIMER COAT

This invention relates to a golf ball with optical brightener in the primer coat.

U.S. Pat. No. 4,679,795 describes incorporating an optical brightener in the cover. The cover also includes white pigment and may include a blue pigment or bluing agent such as Ultramarine Blue. A glossy finish is applied to the ball by coating the cover with a clear epoxy primer followed by an outermost clear coat of urethane. The primer coat and the outermost clear coat are transparent, and the color of the ball is molded into the cover.

U.S. Pat. No. 4,798,386 describes incorporating a fluorescent pigment or dye in the cover. The patent also describes applying a transparent coating over the cover.

U.S. Pat. No. 4,865,326 states that a golf ball can be made at less cost by incorporating optical brightener in the outermost clear coat rather than the cover. Less optical brightener is required in the clear coat than in the cover, and the patent states that results comparable to those obtained with optical brightener incorporated in the cover have been obtained with as little as 0.25 grams of optical brightener per 1000 golf balls. The optical brightener in the outermost clear coat can range between 0.3% to 2% or more by weight of the resin solids in the clear coat. The patent also states that incorporating the optical brightener in the clear coat improves the appearance of the ball because with balls containing an optical brightener the clear coat detracts from the brightness of the ball. Example V states that applying a clear coating to a ball with optical brightener in the cover reduced the SIVR brightness rating from 10 to 3.

Wilson Sporting Goods Co., the assignee of this invention, has sold golf balls under the name Ultra which have a distinctive bluish white color. Such Ultra balls were made by incorporating a white pigment, a blue pigment, and an optical brightener in a Surlyn cover. The molded cover was coated with a transparent primer coat and an outermost transparent clear coat. The cover contained about 99% by weight of Surlyn, 0.053% by weight of Uvitex OB optical brightener, and 0.007% by weight of Ultramarine Blue pigment. The primer coat consisted of an epoxy/acrylic/urethane resin system. The outermost clear coat consisted of a solvent based urethane paint system. It is believed that the optical brightener in the cover absorbs light in the ultraviolet range and emits light in the blue visible range and cooperates with the Ultramarine Blue in the cover to provide the distinctive bluish white color.

If the optical brightener is incorporated in the outermost clear coat of the Ultra ball rather than the cover, the same desirable bluish white color is not obtained. It is believed that this is caused by separating the optical brightener and the blue pigment. Also, when the optical brightener is in the outermost clear coat, the optical brightener is subject to wearing and scuffing as the ball is played, and the appearance of the ball is not as durable as when the optical brightener is molded into the cover.

SUMMARY OF THE INVENTION

I have found that the desirable bluish white color of the Ultra golf ball can be retained even though the optical brightener is omitted from the cover by adjusting the amount of white and blue pigment in the cover and by incorporating the optical brightener in the primer coat. The amount of optical brightener in the primer coat is less than the amount which was molded into the cover, which reduces the cost of the ball, and the resulting ball has improved weatherability. The resulting ball is more durable than a ball which has optical brightener in the clear coat because scuffs in the clear coat will not affect the primer and the optical brightener therein. Contrary to the teaching of Pat. No. 4,865,326, which teaches that optical brightener should be incorporated in the outermost clear coat because the clear coat otherwise reduces the brightness of the ball, incorporating the optical brightener in the primer with adjusted white and blue pigment levels in the cover provides a bright bluish white ball with a more durable appearance. Such a ball can also be used in a UV cure system for the outermost clear coat because the optical brighteners in the primer will not interfere with the UV cure photoinitiator in the clear coat.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
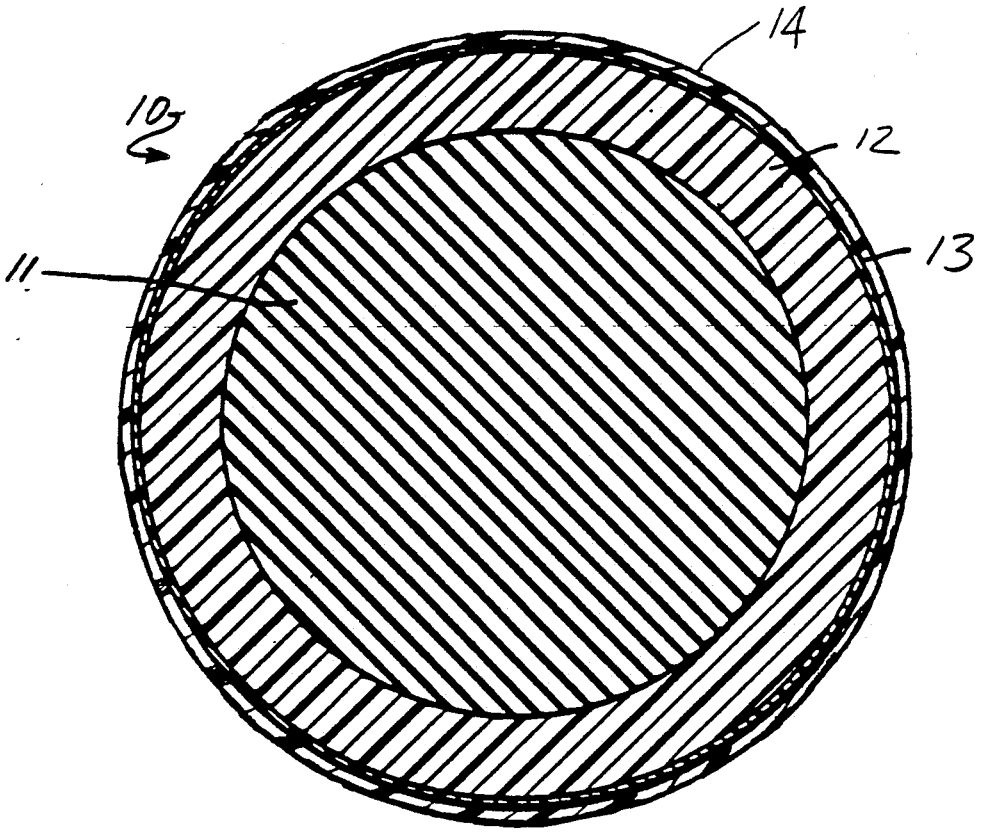
FIG. 1 is a cross sectional view of a golf ball which is formed in accordance with the invention.

Referring to the drawing, a golf ball 10 includes a core 11 and a cover 12. The cover is coated with a transparent primer coat 13 and 14 outermost clear coat or finish coat 14. The drawing is not to scale, and the thicknesses of the primer coat and the clear coat may be exaggerated for clarity of illustration.

The core 11 can be either a solid molded core of one or more layers or a two-piece, wound core which consists of a solid or liquid-filled rubber center and a layer of elastic windings which are wound about the center. The cover can be formed from balata, or synthetic polymeric material such as urethane or ionomeric resins such as Surlyn, and ionic copolymer available from E.I. DuPont de Nemours & Co. Ionomeric covers can consist of either single type ionomer or a blend of two or more ionomers. Solid and wound cores and balata and Surlyn covers are well known in the art, and a detailed description thereof is unnecessary.

The cover can be injection molded about the core or can be formed from two hemispherical half shells which are compression molded about the core. Suitable dimples are molded into the cover during the molding operation.

The cover includes a white pigment such as $TiO_2$ or ZnO and preferably also includes a blue pigment or bluing agent such as Ultramarine Blue. The white pigment can consist of about 0.50 to 10.0% by weight of the cover, and the blue pigment can consist of about 0.002 to 0.05% by weight of the cover. The polymeric material can consist of about 90.0 to 99.0% by weight of the cover.

The primer coat 13 is preferably a waterborne epoxy/acrylic/urethane resin system and includes an optical brightener. An optical brightener is a material which absorbs light in the ultraviolet range and emits in the blue range of visible light. A typical brightener for use in an aqueous primer system is Tinopal S F P, family name: Triazinol Benzenedisulfonic Acid derivative.

Chemical name:

2,2'-(1,2-Ethenediylbis((3-Sulfo-4,1-Phenylene)Imino(6-(Diethylamino)-1,3,5-Triazine-4,2-Diyl)Imino))Bis1,4-Benzenedisulfonic Acid, Hexasodium Salt It is understood that the primer coat 13 can also be a solvent-based primer system and include an optical brightener. Typical optical brighteners for use in this type of system include, Uvitex OB which is available from Ciba-Geigy Chemical Co., Leucopure EGM from Sandoz, Phorwhite K-2002 from Mobay Chemical Corp., and Eastobrite OB-1 from Eastman Chemical Products, Inc. Other optical brighteners and the chemical formulas of optical brighteners are described in U.S. Pat. Nos. 4,679,795 and 4,865,326. Those descriptions of optical brighteners and the chemical formulas thereof are incorporated herein by reference.

The primer coat 10 is preferably optically transparent and is free or essentially free of pigment. The amount of optical brightener may be about 0.45 to 2.7% by weight of the solids content of the primer coat, and preferably about 1.8 to 2.5% by weight.

White or other pigments or dyes can be added in suitable quantities with the optical brightener to the primer coat 13 while maintaining a desirable blue white appearance.

The outermost clear coat 14 preferably consists of a solvent two component urethane paint system, although other systems can easily be used. The clear coat is optically transparent and is free or essentially free of pigment. Trace amounts of optical brightener have traditionally been included in the top coat, and this practice may be continued with the invention. By "trace amounts" I mean an amount of optical brightener that is no more than about 0.04% by weight of the solids content of the top coat.

The blue-white color of the cover is visible through the transparent primer coat 13 and clear coat 14, and the blue-white color is enhanced by the optical brightener in the primer coat. The optical brightener in the primer coat is protected by the clear coat, and the optical brightener remains unaffected if the clear coat is scuffed.

Golf balls made in accordance with the invention can be cured in a ultraviolet (UV) cure system in which the outermost clear coat containing a UV photoinitiator is cured with UV light. The UV light cross links the clear coat in a very short time, e.g., about 25 to 30 seconds, compared to the much longer cure time, e.g., about four hours, that a two component system requires. A UV cure system permits balls to be finished and packaged faster and reduces labor and scrap. I have found that if the outermost clear coat uses optical brightener in the levels described in Pat. No. 4,865,326, the optical brightener can inhibit UV curing. The details of UV curing are known in the art, and a detailed description thereof is unnecessary.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A golf ball comprising a core and a cover, the cover having a transparent primer coat and an outermost transparent clear coat, the primer coat having an optical brightener admixed therein, the optical brightener constituting about 0.45 to 2.7% by weight of the solids content of the primer coat.

2. The golf ball of claim 1 in which the optical brightener constitutes about 1.8 to 2.5% by weight of the solids content of the primer coat.

3. The golf ball of claim 1 in which the clear coat is optically clear and contains no more than trace amounts of optical brightener.

4. The golf ball of claim 1 in which the primer coat is a waterborne paint system.

5. The golf ball of claim 4 in which the cover is essentially free of optical brightener.

6. The golf ball of claim 1 in which the primer coat is a solvent based paint system.

7. The golf ball of claim 6 in which the cover is essentially free of optical brightener.

8. The golf ball of claim 1 in which the cover comprises from about 90.0 to 99.0% by weight of polymeric material, from about 0.50 to 10.0% by weight of white pigment, and from 0.002 to 0.05% by weight of a bluing agent.

* * * * *